US009352893B2

(12) United States Patent
Utz et al.

(10) Patent No.: US 9,352,893 B2
(45) Date of Patent: May 31, 2016

(54) SELF-VENTING PACKAGE

(75) Inventors: Helmar Utz, Koppigen (CH); Régine Tornay, Aefligen (CH); Peder Ladefoged Nielsen, Horsens (DK)

(73) Assignee: Amcor Flexibles Transpac N.V., Zaventem (BE)

( * ) Notice: Subject to any disclaimer, the term of this patent is extended or adjusted under 35 U.S.C. 154(b) by 0 days.

(21) Appl. No.: 14/378,903

(22) PCT Filed: Feb. 17, 2012

(86) PCT No.: PCT/EP2012/052789

§ 371 (c)(1),
(2), (4) Date: Jan. 23, 2015

(87) PCT Pub. No.: WO2013/120535

PCT Pub. Date: Aug. 22, 2013

(65) Prior Publication Data

US 2015/0344210 A1 Dec. 3, 2015

(51) Int. Cl.

| | |
|---|---|
| ***B65D 33/01*** | (2006.01) |
| ***B65D 81/34*** | (2006.01) |
| ***B65D 65/02*** | (2006.01) |
| ***B65D 75/20*** | (2006.01) |
| ***B65D 75/58*** | (2006.01) |
| ***B65B 51/22*** | (2006.01) |
| ***B65D 77/22*** | (2006.01) |

(52) U.S. Cl.

CPC ..... *B65D 81/3461* (2013.01); *B65B 51/225* (2013.01); *B65D 65/02* (2013.01); *B65D 75/20* (2013.01); *B65D 75/58* (2013.01); *B65D 77/225* (2013.01)

(58) Field of Classification Search

CPC .... B65D 33/01; B65D 75/525; B65D 77/225; B65D 81/3461

USPC ..... 383/100–103

See application file for complete search history.

(56) References Cited

U.S. PATENT DOCUMENTS

| | | | | |
|---|---|---|---|---|
| 3,937,396 | A | 2/1976 | Schneider | |
| 2006/0127549 | A1 | 6/2006 | Murray | |
| 2010/0266732 | A1 * | 10/2010 | Thomas | B65D 77/225 426/113 |

(Continued)

FOREIGN PATENT DOCUMENTS

| | | | |
|---|---|---|---|
| EP | 2157029 | A1 | 2/2010 |
| JP | 2005187079 | A * | 7/2005 |
| JP | 2007276832 | A * | 10/2007 |

(Continued)

*Primary Examiner* — Jes F Pascua

(74) *Attorney, Agent, or Firm* — Reinhart Boerner Van Deuren P.C.

(57) ABSTRACT

The present invention discloses a self-venting package (6) for packing a food preparation and warming it up comprising at least one flexible film forming a first wall comprising a sealant layer (9) and a support layer (10), said flexible film being sealed by a peripheral seal (4) onto a second wall or on itself, thereby forming a main enclosure confining the food preparation; a rupturable seal (3) isolating a venting hole (1) from said main enclosure, said rupturable seal being arranged for opening, in use, a path to the venting hole upon internal pressure increase in said main enclosure, characterized in that a specific region (5) of the rupturable seal is weakened by means of a welded area with a reduced sealant layer thickness, said welded area guiding, in use, the rupture of said rupturable seal to the venting hole.

11 Claims, 4 Drawing Sheets

(56) References Cited

U.S. PATENT DOCUMENTS

| | | | | |
|---|---|---|---|---|
| 2011/0179754 | A1* | 7/2011 | Utz | B65D 81/3461 53/467 |
| 2013/0048636 | A1* | 2/2013 | Mack | B65D 77/225 220/203.16 |

FOREIGN PATENT DOCUMENTS

| | | | | |
|---|---|---|---|---|
| JP | 2008013223 | A | * | 1/2008 |
| JP | 2013086871 | A | * | 5/2013 |
| WO | WO 2013/100058 | A1 | * | 7/2013 |
| WO | WO 2013/100060 | A1 | * | 7/2013 |

* cited by examiner

SELF-VENTING PACKAGE

FIELD OF THE INVENTION

The present invention is related to a self-venting package for packing a food preparation and warming it up.

STATE OF THE ART

The demand on ready meals which have to be just reheated is constantly growing. Such ready meals are often packed in suitable packagings such as for instance trays with a lidding film or pouches.

For convenience reasons microwave heating is the preferred way to reheat this kind of meals.

To avoid bursting when the hermetically packed product is heated, conventional trays or pouches have to be at least partially opened or perforated to allow the steam to escape when the meal becomes hot and the contained water transforms into vapour.

To avoid the necessity of opening before heating, several valve systems integrated in the packaging (in the laminate, add-ons or additional seals) have been developed, which allow heating of e.g. vegetables or ready meals in the microwave oven. These systems have advantages like a steam cooking effect, less humidity loss or an indication that the product is hot by an opening noise of the valve.

U.S. Pat. No. 3,937,396 discloses a self-venting packaging comprising a rupturable seal surrounding a venting hole. In such a packaging, the venting occurs when the internal pressure due to vapour generation is high enough to burst the rupturable seal, the vapour escaping through the venting hole.

The rupturable seal may be obtained by cohesive rupture propagation through an intrinsically peelable sealant layer. In that case, the seal strength of the peripheral seal is about the same as the rupturable seal, this latter opening before the peripheral seal thanks to geometrical factors concentrating stress around the hole. In that case, there is a risk that the peripheral seal bursts before the rupturable seal, the content of the package then leaking in the oven.

As an alternative, bimodal sealant layers having a permanent sealing temperature and a peelable sealing temperature have been used, the rupturable seal being performed at the peelable sealing temperature. Usually, such bimodal sealant layers have a very narrow sealing temperature window, so that the risk also exists that the peripheral seal bursts before the rupturable seal.

AIMS OF THE INVENTION

The present invention aims to provide a solution overcoming the drawbacks of the prior art and more specifically, the present invention aims to provide a self-venting pouch having a reduced risk of leaking due to bursting of the peripheral seal and a method for producing said self-venting pouch.

SUMMARY OF THE INVENTION

The present invention is related to a self-venting package for packing a food preparation and warming it up comprising:

at least one flexible film forming a first wall comprising a sealant layer and a support layer, said flexible film being sealed by a peripheral seal onto a second wall or on itself, thereby forming a main enclosure confining the food preparation;

a rupturable seal isolating a venting hole from said main enclosure, said rupturable seal being arranged for opening, in use, a path to the venting hole upon internal pressure increase in said main enclosure, characterised in that a specific region of the rupturable seal is weakened by means of a welded area with a reduced sealant layer thickness, said welded area guiding, in use, the rupture of said rupturable seal to the venting hole.

According to particular preferred embodiments, the self-venting package of the invention comprises one or a suitable combination of at least two of the following features:

the welded area is a welded line;

the welded area is extending from said main enclosure to the venting hole;

the thickness of the sealant layer material remaining in the welded line represents less than 50%, preferably less than 30% of the thickness of the sealant layer material in the rest of the rupturable seal;

the venting hole is located inside said peripheral seal;

the rupturable seal comprises a corner directed toward the main enclosure;

the welded area is extending from the corner to the venting hole;

the venting hole is surrounded by an unsealed area;

the self-venting package withstands a microwave heating process.

Another aspect of the invention is related to a method for producing a self-venting package according to the invention, wherein the weakened area is produced by an ultrasonic sealing device.

In said method, the thickness of the sealant layer material remaining in the weakened area is preferably controlled by a predetermined die gap.

FIGURE KEYS

Figure 1:
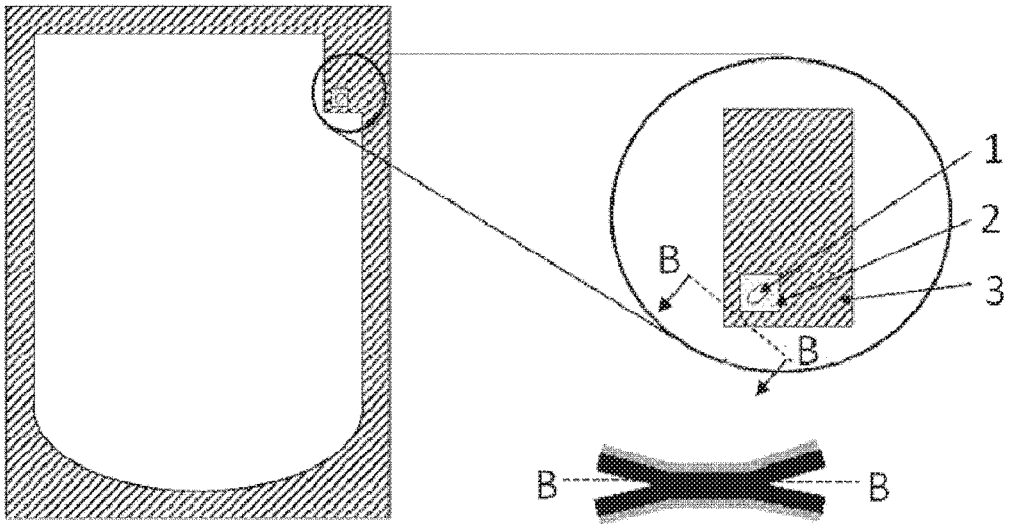
Figure 1 Prior Art
FIG. 1 shows a prior art self-venting pouch with over-pressure valve (venting valve).

1. Venting hole
2. Unsealed area
3. Rupturable seal
4. Peripheral seal
5. Welded area
6. Self-venting pouch
7. Sonotrode

8. Anvil
9. Support layer
10. Sealant layer
11. Sealant layer material expelled from the welded line

DETAILED DESCRIPTION OF THE INVENTION

The present invention is related to a self-venting package 6 comprising at least one flexible film forming a first wall comprising a sealant layer 9 and a support layer 10, said flexible film being sealed by a peripheral seal 4 onto a second wall or on itself, thereby forming a main enclosure confining the food preparation. During cooking, the inner pressure builds up due to the boiling water contained in the food preparation, which may burst the peripheral seal 4, so that the food items leak out of the pouch, spoiling the oven.

To avoid this, it is known in the art to perforate a venting hole 1 in the at least one flexible film to reduce the inner pressure. In order to maintain the packaging closed during the shelf life of the product, the venting hole 1 is usually isolated from the main enclosure by a rupturable seal 3 surrounding the venting hole, said rupturable seal 3 bursting before the peripheral seal in the cooking process, thereby opening a path between the enclosure and the venting hole 1. In many cases, the strength level of said rupturable seal 3 is hard to control and the valve opening is mainly controlled by geometrical parameters.

By rupturable seal, it is meant a seal which may peel either by adhesive rupture at the sealing interface or by cohesive rupture of a rupturable layer.

In order to avoid the risks of bursting of the peripheral seal 4, the present invention discloses the use of a welded area 5 locally weakening the rupturable seal 3 to a very low strength level. Said welded area can be a straight line or any suitable shape adapted to guide the rupture of the rupturable seal 3 from the inside of the package 6 to the venting hole 1.

The geometry of the welded area is arranged for facilitating the initiation of the rupture of the rupturable seal 3 and for guiding the propagation of the rupture of the rupturable seal 3 to the venting hole 1 or to an unsealed area 2 communicating with the venting hole 1. Therefore, the welded area can advantageously consist of a welded line 5 which extends from the outside periphery of the rupturable seal 3 to the venting hole 1 or to an unsealed area 2 surrounding the venting hole 1.

Figure 8:
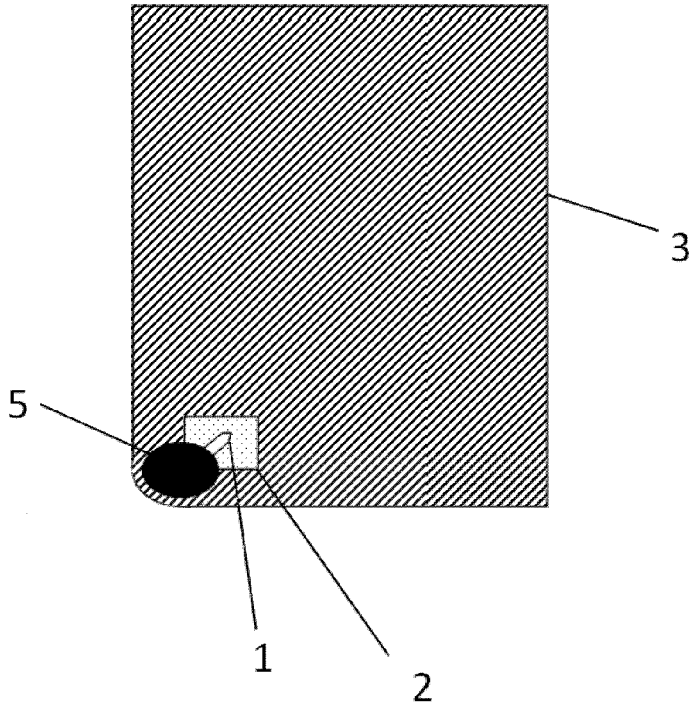
FIG. 8 represents a schematic view of an example of a self-venting valve according to the invention, wherein an ultrasonic welding having rounded edges is made inside of a heat seal (peelable) also having rounded edges.

In order to improve the resistance of the package to logistic constraints (transportation, storage, . . . ) and to avoid an untimely activation of the self-venting valve, the welded area can be separated from the inside of the package and/or from the venting hole by a narrow rupturable seal area, as represented in FIG. 8. For example, this narrow rupturable seal area can separate the inside of the package from the welded area by a distance of about 1 mm (0.5 to 2 mm).

Advantageously, the welded area 5 is produced by a welding process, wherein the interface between the two films is locally heated. This local heating allows to selectively melt the interface area (i.e. the sealant layer) and, by applying pressure to the external surfaces, to expel the melted sealant layer material from the welded area.

Examples of welding processes locally heating the interface are radio-frequency welding, laser welding, friction welding or ultrasonic welding.

Radio-frequency welding and laser welding have strong limitations in terms of possible composition (i.e. RF-responsive material or transparent material sealed on opaque material) and are therefore limited to very specific applications.

Friction welding, using friction of initially free surfaces, imposes to produce the welded line before sealing the rupturable layer, which may be more difficult from a process standpoint.

Therefore, the welded line is preferably produced by an ultrasonic welding process. In such a process, the maximum energy absorption may be controlled by the position of the antinodes of the applied sonic wave.

Figure 5:
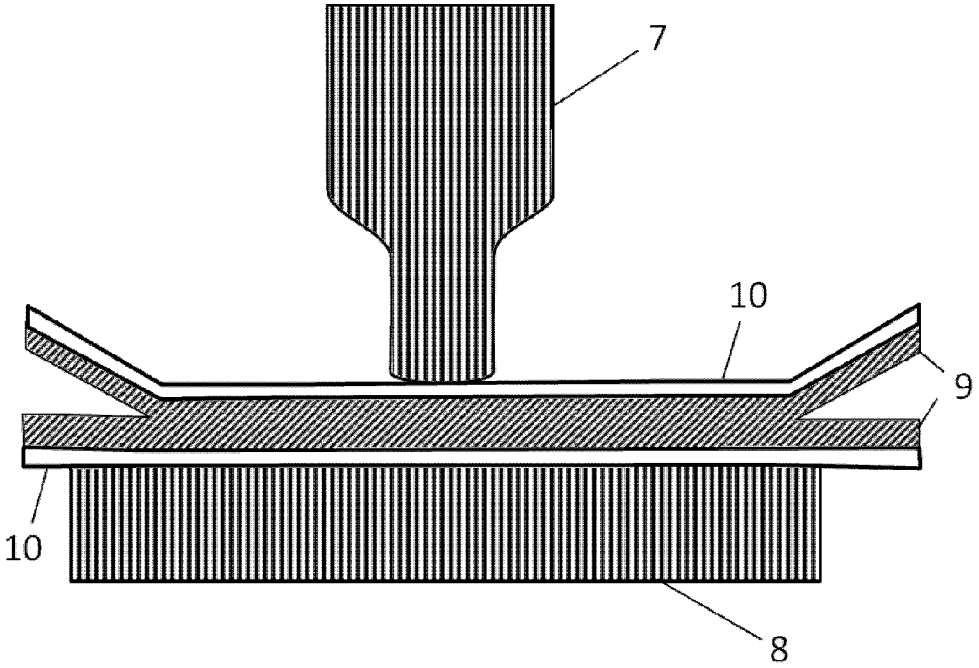
FIG. 5 shows an ultrasonic sealing process, before sonic welding.
Figure 6:
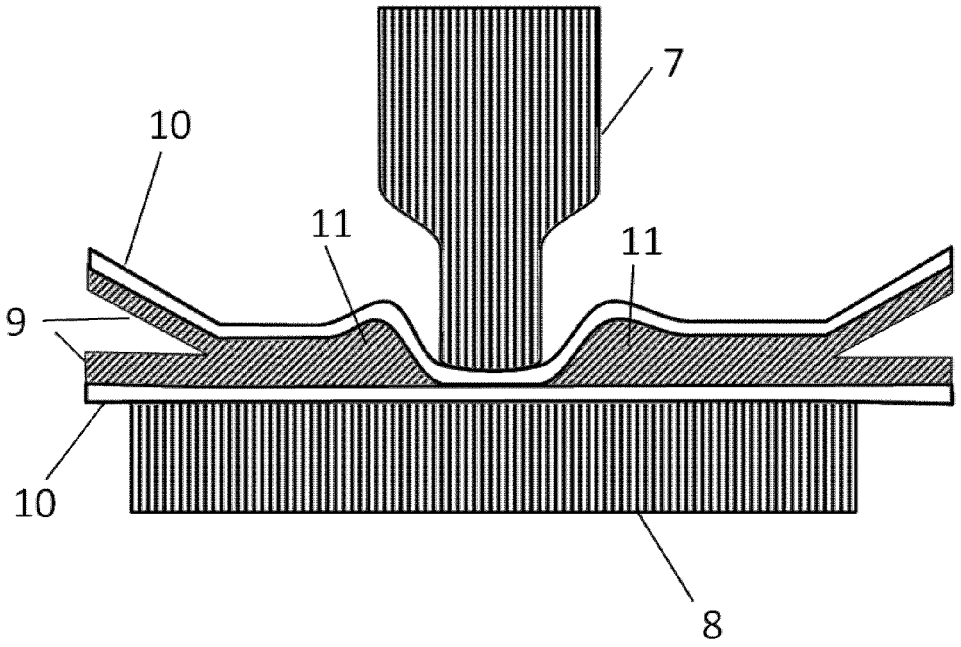
FIG. 6 shows an ultrasonic sealing process, after sonic welding.
Figure 7:
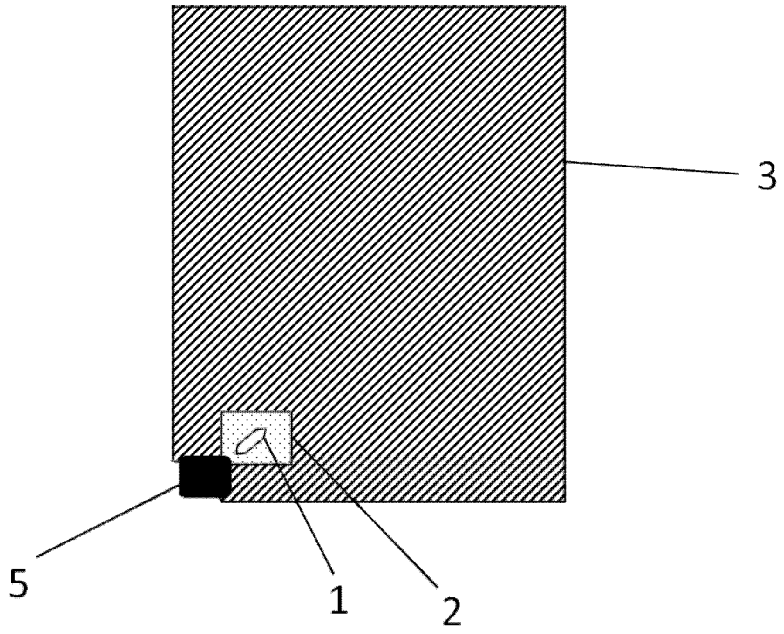
FIG. 7 represents a schematic view of an example of a self-venting valve according to the invention, wherein an ultrasonic welding is made outside of a heat seal (peelable).

In order to control the thickness of the remaining sealant layer material and in order to reduce the risk of perforation of the pouch, the die gap is preferably precisely controlled. In ultrasonic welding, the die gap is the minimum distance between the sonotrode 7 and the anvil 8 during one welding cycle (see FIGS. 5 and 6).

Preferably, the reduced sealant layer thickness represents less than 50%, preferably less than 30% and most preferably less than 10% of the initial sealant layer thickness.

Preferably, the materials used in the package of the invention are not responsive and transparent to microwave, so that cooking may be performed in a microwave oven.

The second wall of the package of the invention may be a thermoformed tray or a second flexible film. Alternatively, the enclosure may be obtained by folding a film on itself.

Advantageously, the package of the invention comprises folds or other means arranged for maintaining it in a standing position during the cooking process (standing pouch).

For convenience's sake, the venting hole 1 is located in the upward area of the package when standing up, so that no leak of liquid may happen during venting.

Preferably the venting hole is located inside the peripheral seal 4, so that the stress concentration occurs on the surrounding rupturable seal 3 upon inner pressure build-up.

In order to further increase the stress concentration on the rupturable seal 3 upon pressure build-up, the rupturable seal preferably comprises a corner (angular point) oriented toward the main enclosure. In this latter case, the welded area 5 preferably extends from said corner to the venting hole 1 or to an unsealed area 2 around the venting hole.

The support layer 10 may comprise more than one functional sublayer, in order to bring additional functionalities: gas barrier layers, water vapour barrier layers, adhesive layers (so called "tie layers"), printed layers, etc.

Preferably, the support layer comprises at least one sublayer comprising a polymer selected from the group consisting of polyester (PET, PETG) and polyamide (PA6; PA6,6; PA MXD6). The support layer is advantageously oriented (OPA).

Preferably, the support layer further comprises a metal oxide coating, such as AlOx or SiOx or an organic barrier coating such as an acrylic-based coating.

Preferably, the sealant layer comprises a polyolefin well-known by those skilled in the art, such as for example polypropylene, polyethylene, their copolymers and their blends.

EXAMPLES

Example 1

A packaging according to the invention has been produced and tested.

The structure was made from two sheets of 185×140 mm with 40 mm round gusset, the laminated sheets having the following structure:

12 μm PET-AlOx/15 μm OPA 70 μm PP.

Figure 2:
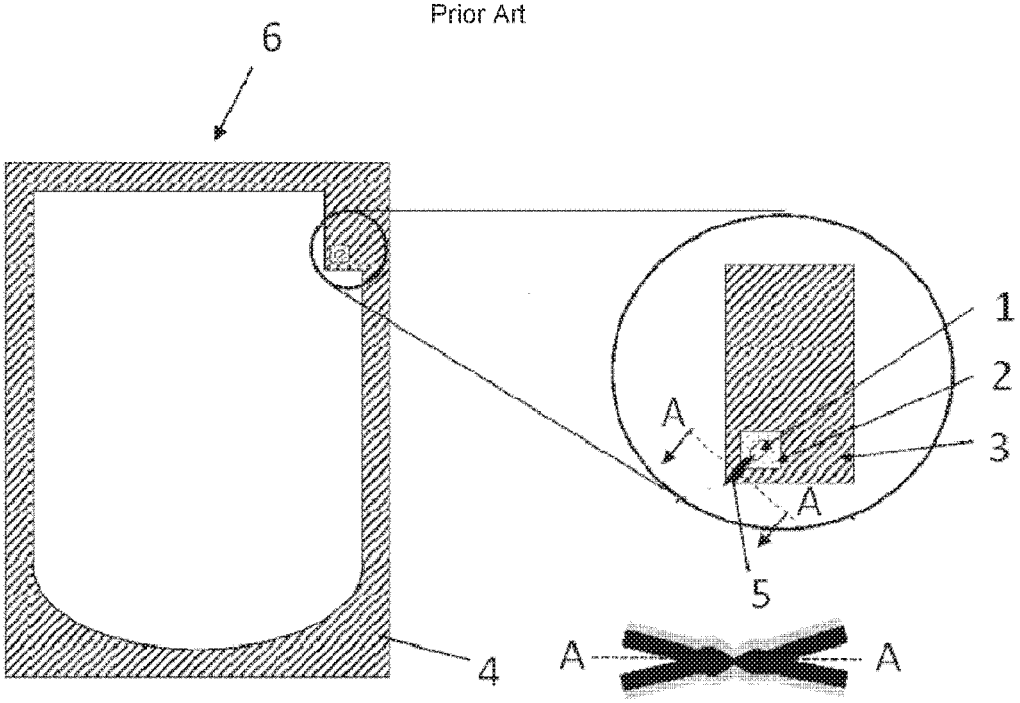
FIG. 2 shows a self-venting package according to the invention with an over-pressure valve.
Figure 3:
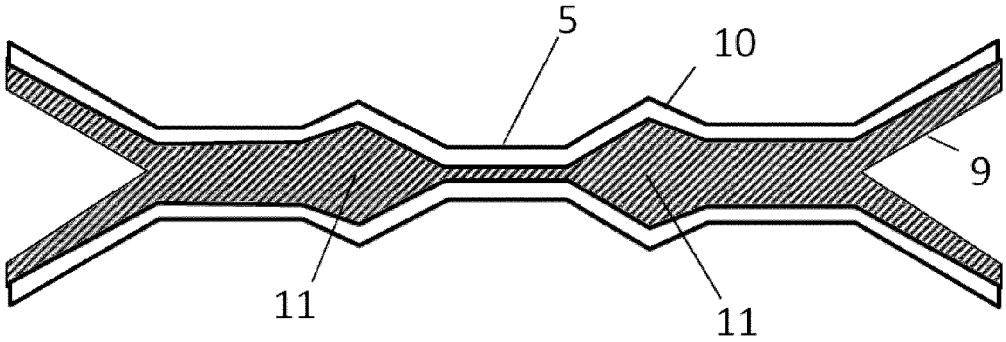
FIG. 3 shows an example of a cross-section along the A-A axis of FIG. 2, with reduced sealant layer material remaining in the welded line of the self-venting package according to the invention.
Figure 4:
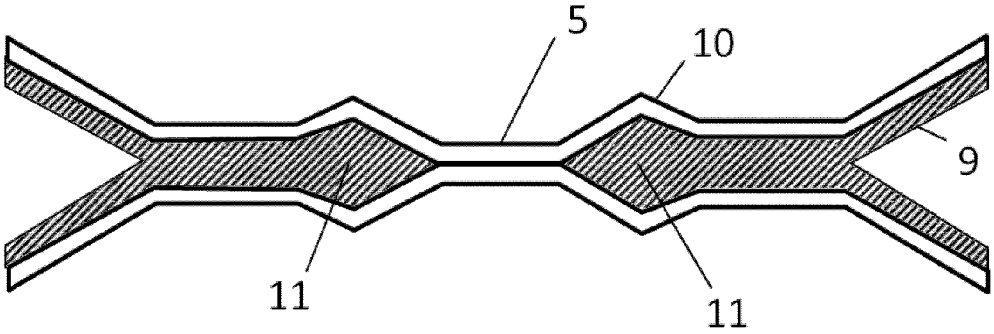
FIG. 4 shows an example of a cross-section along the A-A axis of FIG. 2, with almost no sealant layer material remaining in the welded line of the self-venting package according to the invention.

The peripheral seal was performed on a Totani pouch making machine, at 200° C. setting temperature and 120 N/cm$^2$ applied pressure. A Herrmann Ultraschall PS Dialog ultrasonic table top system (35 kHz) was used to apply an additional ultrasonic seal as shown in FIG. 2. The sonotrode was flat and the anvil profiled. The amplitude was 80%, time 120 ms and the force 60 N.

When testing pouches (filled with 200 ml water and closed) without the ultrasonic seal in a microwave oven, about 30% of the pouches did fail (burst at side seal and gusset), as the valve seal was too strong when sealed at 200° C. All pouches with the additional ultrasonic seal did open in the microwave via the valve.

Example 2

A laminate with a structure PET-AlOx 12/OPA 15/PP 70 was used to produce stand up pouches (185×140+40 round gusset) on a Totani pouch making machine. In line an additional ultrasonic seal was applied as shown in FIG. 8 (35 kHz, amplitude 75%, time 40 ms, force 70 N). The valve heat seal was produced after the ultrasonic seal (sealing temperature 185° C., pressure 130 N/cm$^2$). Filled with 200 ml water and closed, pouches were tested in a microwave oven and all opened via the valve.

Example 3

A laminate with a structure PET-AlOx 12/OPA 15/PP 100 was used to produce stand up pouches (185×140+40 mm round gusset) on a Totani pouch making machine. In line an additional ultrasonic seal was applied as shown in FIG. 8 (35 kHz, amplitude 80%, time 60 ms, force 70 N). The valve heat seal (sealing temperature 190° C., pressure 130 N/cm$^2$) was produced before the ultrasonic seal (35 kHz, amplitude 75%, time 40 ms, force 70 N. Filled with 200 ml water and closed, pouches were tested in a microwave oven and all opened via the valve.

The invention claimed is:

1. Self-venting package for packing a food preparation and warming it up comprising:

at least one flexible film forming a first wall comprising a sealant layer and a support layer, said flexible film being sealed by a peripheral seal onto a second wall or on itself, thereby forming a main enclosure confining the food preparation; and a rupturable seal isolating a venting hole from said main enclosure, said rupturable seal being arranged for opening, in use, a path to the venting hole upon internal pressure increase in said main enclosure, characterized in that a specific region of the rupturable seal is weakened by means of a welded area with a reduced sealant layer thickness, said welded area guiding, in use, the rupture of said rupturable seal to the venting hole, wherein the thickness of the sealant layer material remaining in the welded line represents less than 50% of the thickness of the sealant layer material in the rest of the rupturable seal.

2. The self-venting package according to claim 1, wherein the welded area is a welded line.

3. The self-venting package according to claim 1, wherein the welded area is extending from said main enclosure to the venting hole.

4. The self-venting package according to claim 1, wherein the thickness of the sealant layer material remaining in the welded line represents less than 30% of the thickness of the sealant layer material in the rest of the rupturable seal.

5. The self-venting package according to claim 1, wherein the venting hole is located inside said peripheral seal.

6. The self-venting package according to claim 1, wherein the rupturable seal comprises a corner directed toward the main enclosure.

7. The self-venting package according to claim 6, wherein said welded area is extending from the corner to the venting hole.

8. The self-venting package according to claim 1, wherein the venting hole is surrounded by an unsealed area.

9. The self-venting package according to claim 1, wherein said self-venting package withstands a microwave heating process.

10. Method for producing a self-venting package according to claim 1, wherein the weakened area is produced by an ultrasonic sealing device.

11. Method according to claim 10, wherein the thickness of the sealant layer material remaining in the weakened area is controlled by a predetermined die gap.

* * * * *